US010694785B2

(12) United States Patent
Santos

(10) Patent No.: US 10,694,785 B2
(45) Date of Patent: Jun. 30, 2020

(54) NON-REBUILDABLE VAPORIZATION TANK

(71) Applicant: Rodrigo Escorcio Santos, Bethesda, MD (US)

(72) Inventor: Rodrigo Escorcio Santos, Bethesda, MD (US)

( * ) Notice: Subject to any disclaimer, the term of this patent is extended or adjusted under 35 U.S.C. 154(b) by 0 days.

(21) Appl. No.: 16/142,311

(22) Filed: Sep. 26, 2018

(65) Prior Publication Data

US 2020/0029620 A1 Jan. 30, 2020

Related U.S. Application Data

(60) Provisional application No. 62/702,959, filed on Jul. 25, 2018.

(51) Int. Cl.

| | |
|---|---|
| ***A24F 47/00*** | (2020.01) |
| ***A24F 7/00*** | (2006.01) |
| ***A24F 40/44*** | (2020.01) |

(52) U.S. Cl.

CPC ..... *A24F 47/008* (2013.01); *A24F 7/00* (2013.01); *A24F 40/44* (2020.01)

(58) Field of Classification Search

USPC ..... 131/329

See application file for complete search history.

(56) References Cited

U.S. PATENT DOCUMENTS

| | | | | |
|---|---|---|---|---|
| 9,820,512 | B2 | 11/2017 | Mironov et al. | |
| 2014/0261493 | A1* | 9/2014 | Smith | A24F 47/008 131/328 |
| 2017/0105452 | A1* | 4/2017 | Mironov | A24F 47/008 |
| 2017/0231283 | A1* | 8/2017 | Gadas | A24F 7/02 131/329 |

OTHER PUBLICATIONS

Tobacco Meets Technology, IQOS—PMI—Philip Morris International, http://www.pmi.com/smoke-free-products/iqs-our-tobacco-heating-system, accessed Sep. 5, 2018, 5 pages.

Vaping Underground, Stainless Steel Mesh vs Japanese Organic Cotton Sheets—Vaping Underground Forums—An Ecig and Vaping Forum, http://vapingunderground.com/threads/stainless-steel-vs-japanese-orgnic-cotton-sheets.30081, accessed Jul. 18, 2018, 4 pages.

Best Vape Tanks for Clouds, Flavor and More, Vapingdaily, The Voice of Vaping, Best Vape Tanks of 2018, Buying Guide and Reviews, https://vapingdaily.com/vape-tanks/, Published Mar. 7, 2017, Updated Jul. 4, 2018, accessed Jul. 18, 2018, 26 pages.

New Patent Sativa Glass Tank Atomizer 1ml.8ml Glass Vape Pen Ceramic Cartridges—Buy Glass Cartridge Vape, https://www.alibaba.com/product-detail/New-patent-sativa-glass-tank-atomizer_60662663226.html, accessed Jul. 18, 2018, 16 pages.

James Bickford, Never Skimp, Get the Best Cotton for Vaping, Vapingdaily Blog, https://vapingdaily.com/blog/never-skimp-get-best-cotton-vaping/, Published Jan. 17, 2018, accseed Jul. 18, 2018, 23 pages.

* cited by examiner

*Primary Examiner* — Eric Yaary

(74) *Attorney, Agent, or Firm* — Edell, Shapiro & Finnan, LLC

(57) ABSTRACT

A non-rebuildable tank for a portable vaporization device is disclosed. According to at least one embodiment, the non-rebuildable tank includes a heating element and a wick that are enclosed within a tank enclosure filled with liquid that is consumable and/or inhalable as a vapor. The wick is a metal or ferrite mesh element that surrounds or encircles the heating element so that the wick controls a flow of liquid to the heating element by absorbing the liquid and slowly wicking the liquid into the heating element.

20 Claims, 6 Drawing Sheets

NON-REBUILDABLE VAPORIZATION TANK

CROSS-REFERENCE TO RELATED APPLICATIONS

This application claims priority to and the benefit of U.S. Provisional Patent Application No. 62/702,959, filed Jul. 25, 2018, entitled "Non-Rebuildable Vaporization Tank."

FIELD OF THE INVENTION

The present invention is directed toward a vaporization tank, and in particular to a prefabricated or non-rebuildable tank atomizer with a mesh wick, such as a stainless steel mesh wick, that encases or encircles a heating element included in the tank atomizer.

BACKGROUND OF THE INVENTION

In view of developments in technology and the law, vaporization devices have become quite popular. Initially, vaporization devices were quite large and burdensome, but over time, vaporization devices have decreased in size so that the vaporization devices are portable and fit easily into a pocket included in a garment. For example, portable vaporization devices may be shaped and sized like pens. To function, a vaporization device heats a consumable and/or inhalable product such as oils, concentrates, and combustible plant substances to create a vapor for a user to inhale. Heating liquid consumables, such as oil, has become particularly popular since liquids may be more concentrated and/or specialized as compared to plant substances and because a quantity of liquid may last longer than a similar quantity of plant substance (which may further decrease the amount of materials that a vaporization user needs to carry).

There are currently a wide variety of vaporization devices, even within specific focuses, such as liquid vaporization. For example, some liquid vaporization devices include rebuildable atomizers (e.g., rebuildable dripping atomizers (RDAs) or rebuildable tank atomizers (RTAs)). These atomizers include a heating element, typically in the form of coils that heats a liquid and produces a vapor, and the heating element is accessible by a user so that, for example, a user can replace or modify the coils and/or insert wicks into the coils. Traditionally, users insert a wick by rolling up cotton and inserting the rolled up cotton into the coils, but in some instances, users have also utilized rolled-up stainless steel as wicks. However, since these rebuildable devices provide access to the coils (e.g., access to a heating element), a user must have an understanding of how the device works in order to maintain and operate a rebuildable device.

On the other hand, non-rebuildable liquid vaporization devices (sometimes referred to as tanks or pods) seal an atomizer within a tank that is filled of fillable with liquid. Often, these tanks include an annular ceramic atomizer (instead of a wick and a heating element). Liquid is disposed around the annular ceramic atomizer and heated to produce a vapor as it passes through the annular ceramic atomizer, so that vapor is created within an interior cavity formed within the annular ceramic atomizer. The vapor can then be inhaled through a mouthpiece fluidly connected to the interior cavity. However, instead of a wick, a bottom-up airflow (e.g., an airflow entering at a bottom of a tank and drawn upwards, through the tank, to the mouthpiece by a person drawing air inwards from the mouthpiece) is usually utilized to draw fluid into the annular ceramic atomizer. In these bottom-up airflow designs, the airflow enters the tank through a hole that extends radially between a bottom of the interior cavity of the annular atomizer and an outer circumference of the tank. Then, the bottom airflow moves upwards towards the mouthpiece, which is aligned with the interior cavity at the top of the tank. Unfortunately, this bottom-up airflow can introduce debris into the tank and/or degrade the tank's components, such as the annular ceramic atomizer. The position of these holes also allows fluid to leak from the tank (e.g., due to the natural pull of gravity), which wastes a user's often expensive liquid and/or creates a mess for the user.

One distinct advantage of non-rebuildable tanks as compared to RDAs or RTAs is that since non-rebuildable tanks are often pre-fabricated units, a user can simply attach a non-rebuildable tank to a battery to create a vaporization device. Aside from this attachment (which is often facilitated by industry-standard threads), no further assembly is required and, often, tanks are disposable after they are used. However, to obtain this advantage, non-rebuildable units are pre-fabricated units that prevent a user from modifying internal components. Thus, even though the annular ceramic atomizers that are typically used for non-rebuildable tanks may provide non-ideal absorption rates and/or may melt or burn, even during the relatively short life span of a disposable tank, these components cannot be replaced by a user. Consequently, improved non-rebuildable tanks are desirable.

SUMMARY OF THE INVENTION

A non-rebuildable tank (sometimes referred to as a pod) for a portable vaporization device is presented herein. According to at least one embodiment, the non-rebuildable tank includes a heating element and a wick that are encased within a tank enclosure filled with liquid that is consumable and/or inhalable as a vapor. The wick is a stainless steel mesh element that encircles the heating element so that the wick controls a flow of liquid to the heating element by absorbing the liquid and slowly wicking the liquid into the heating element.

In at least some embodiments, the non-rebuildable tank is a sealed unit. Additionally or alternatively, the non-rebuildable tank may not allow air to pass through the tank. That is, the tank may have a tank enclosure with a closed bottom that prevents an airflow from entering the tank through the bottom. To facilitate this, in at least some embodiments, the tank enclosure may permit heating element contacts to extend through sealed openings in the bottom of the tank enclosure. That is, heating element contacts may extend through apertures included in the bottom of the tank enclosure and the tank enclosure may include or define seals around each of the contacts.

According to another embodiment of the present disclosure, a non-rebuildable tank for a portable vaporization device includes a sealed tank enclosure, an annular heating element, and a ferrite wick. The sealed tank enclosure contains a vaporizable liquid and the annular heating element is positioned within the tank enclosure and configured to generate heat to cause a phase change of the vaporizable liquid from liquid to vapor when receiving current from a power source. The ferrite wick that surrounds the annular heating element and controls a flow of the vaporizable liquid to the annular heating element.

In some of these embodiments, the annular heating element heats the vaporizable liquid via convective heating. Additionally or alternatively, the ferrite wick does not receive current from the power source. Thus, the ferrite wick does not heat the vaporizable liquid; instead, the heating element heats the vaporizable liquid.

Moreover, in some embodiments, the vaporizable liquid is disposed in a reservoir that is defined between an outer surface of the annular heating element and an inner surface of the sealed tank enclosure. In some of these embodiments, the annular heating element defines an interior chamber that is separate from the reservoir. In these embodiments, the vaporizable liquid may undergo the phase change as it moves from the reservoir to the interior chamber so that liquid is disposed in the reservoir and vapor is disposed in the interior chamber. Moreover, in some of these embodiments, the non-rebuildable tank also includes a mouthpiece and a chimney. The chimney extends between the interior chamber and the mouthpiece so that the reservoir is further defined between an outer surface of the chimney and the inner surface of the sealed tank enclosure.

Still further, in at least some embodiments, the non-rebuildable tank is a sealed unit. This prevents a user from manipulating or breaking any of the components of the tank, such as the heating element and the ferrite wick. In fact, in some embodiments, the tank enclosure includes a top and a bottom, the bottom being completely sealed. This prevents the liquid from leaking out of the bottom, as it may in tanks with bottom airflow openings. In stark contrast, some embodiments of the non-rebuildable tank presented herein may include top airflow openings disposed in the top of the tank enclosure that allow air to be drawn into the heating element. Among other advantages, these openings may discourage leaking while still providing airflow for the tank. Thus, in at least some embodiments, the top airflow openings are the only airflow openings included in the non-rebuildable tank.

According to yet another embodiment of the present disclosure, a portable vaporization device includes a battery component and a non-rebuildable tank. The battery component is configured to generate current. The non-rebuildable tank is mechanically and electrically coupleable to the battery component and includes a sealed tank enclosure an annular heating element, and a ferrite wick. The sealed tank enclosure contains a vaporizable liquid. The annular heating element is positioned within the tank enclosure and configured to generate heat to cause a phase change of the vaporizable liquid from liquid to vapor when receiving the current from the battery component. The ferrite wick that surrounds the annular heating element and controls a flow of the vaporizable liquid to the annular heating element.

BRIEF DESCRIPTION OF THE DRAWINGS

Like reference numerals have been used to identify like elements throughout this disclosure.

DETAILED DESCRIPTION

Present herein is a non-rebuildable tank for a portable vaporization device. The non-rebuildable tank includes an atomizer sealed within a tank enclosure that is filled with liquid which is consumable and/or inhalable as a vapor. The atomizer includes a heating element and a metal or ferrite (e.g., stainless steel) mesh wick that encircles the heating element so that the wick controls a flow of liquid to the heating element by absorbing the liquid and slowly wicking the liquid into the heating element. The wick itself is not heated. Instead, electrical power is delivered to the heating element and the wick controls a flow of liquid to the heating element as it generates heat from the electrical power. However, advantageously, the metal/ferrite mesh wick has a higher burn/melt point as compared to cotton wicks and, thus, the wick will not burn when the heat element is generating heat. Consequently, the metal/ferrite mesh wick will not create a burnt flavor in vapor generated by the atomizer. Moreover, the metal/ferrite mesh wick provides increased absorption as compared to cotton wicks and, thus, may provide a user with increased volumes of vapor (e.g., larger flow rates) if desired.

The non-rebuildable tank presented herein is a sealed unit, insofar as any components included in the non-rebuildable tank are sealed within a tank enclosure and are not accessible by a user unless a user destroys the unit, but the tank still has a mouthpiece that is fluidly connected to an interior chamber defined within the heating element (the liquid to vapor phase change occurs as the liquid passes through the heating element, so that only vapor is present in the interior chamber). Thus, in order to provide power to the heating element, contacts extend through the tank enclosure; this tank enclosure is sealed around the contacts so that air cannot enter the tank adjacent the contacts.

In fact, the non-rebuildable tank presented herein does not include any openings beneath the heating element and, thus, there is no airflow into the heating element from a bottom of the tank (insofar as the bottom is the side opposite a mouthpiece and need not be disposed at a bottom of the tank at all times, such as if the tank is being used in an upside-down position). Instead, the tank presented herein includes openings at a top or the tank, adjacent the mouthpiece. Advantageously, a tank without bottom airflow limits the amount of debris or contaminants from entering the tank (or, more specifically, an interior chamber formed within the heating element) which may ensure that any vapor generated by the tank is clean (e.g., does not contain debris or contaminants) and may also decrease wear of the internal components over their life span. The elimination of bottom airflow also discourages liquid and/or vapor from leaking from the tank, which may waste product and/or create a mess for the user.

Figure 1:
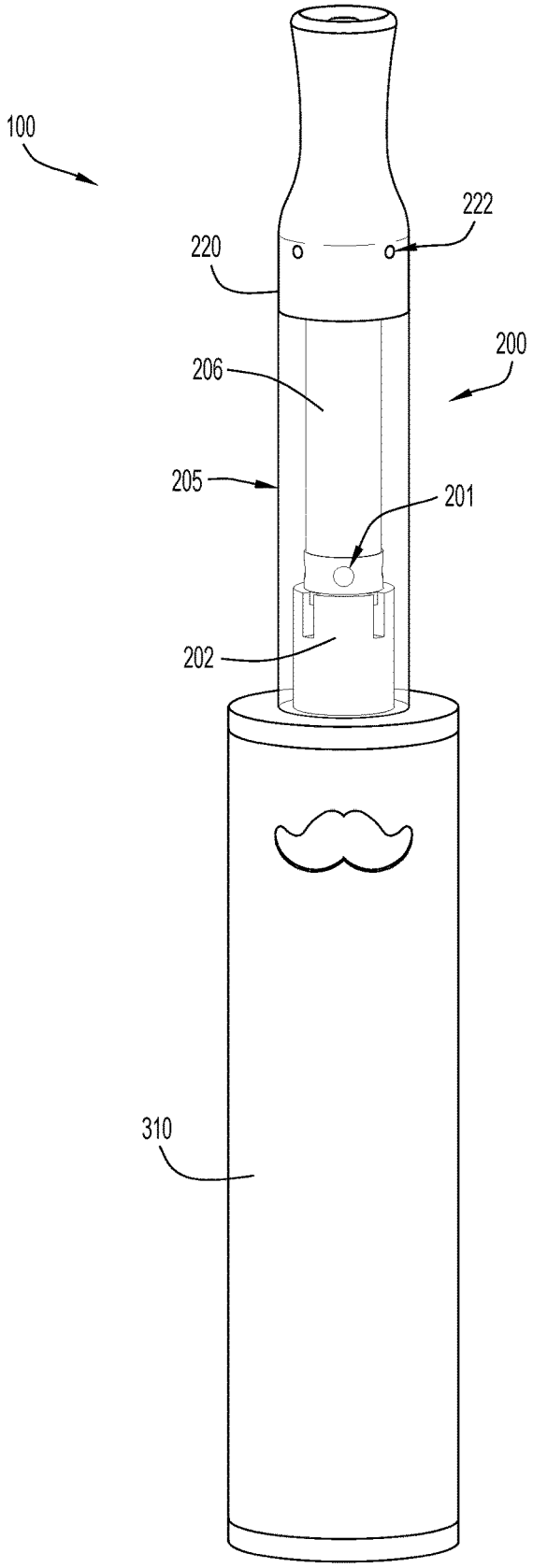
FIG. 1 illustrates a front view of a portable vaporization device including a non-rebuildable tank formed in accordance with an example embodiment of the present invention.
Figure 2:
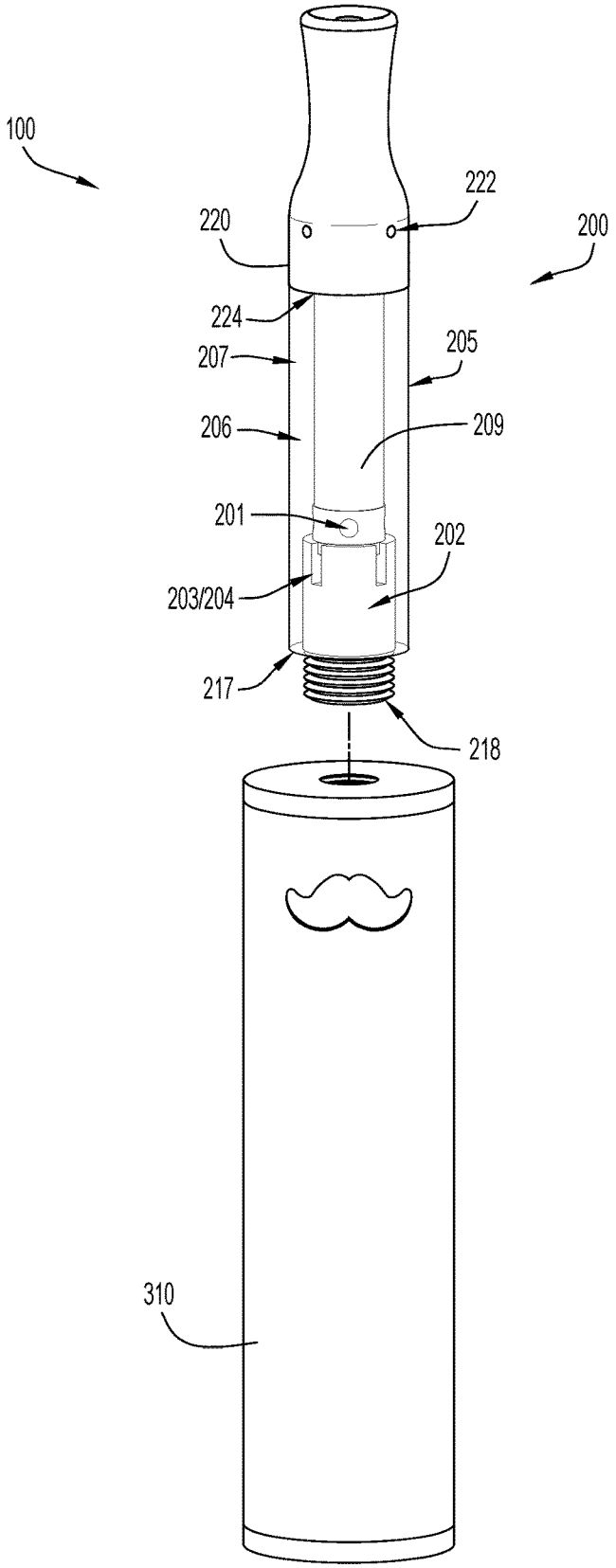
FIG. 2 illustrates the portable vaporization device of FIG. 1 with the non-rebuildable tank disconnected from the battery.
Figure 3:
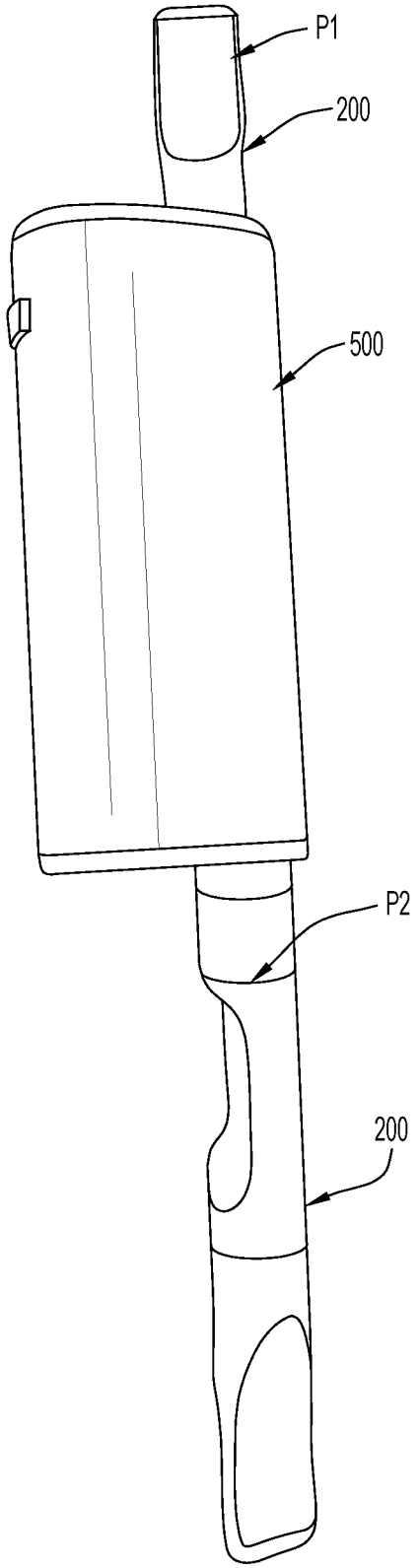
FIG. 3 illustrates a front view of another embodiment of a portable vaporization device including another embodiment of a non-rebuildable tank formed in accordance with an example embodiment of the present invention.

In FIGS. 1-3, the non-rebuildable tank of the present invention is shown installed on various battery units in order to create a vaporization device. More specifically, in FIG. 1, a tank 200 is installed on a battery 310 to create vaporization device 100. Overall, the portable vaporization device 100 is sized to be held in a user's hand (i.e., the device 100 is handheld). The tank 200 includes a mouthpiece 220 that generally defines a top end of the vaporization device and the battery component 310 generally defines a bottom end of the device 100. The battery 310 and mouthpiece 220 shown in FIG. 1 are merely examples, and in other embodiments, the tank 200 can be coupled to any desirable battery or include any desirable mouthpiece.

Generally, the tank 200 includes a tank enclosure 205 and an atomizer 202 that is disposed within (and sealed within) the tank enclosure 205. The atomizer 202 is fluidly connected to the mouthpiece 220 via a chimney 209 (as is explained in further detail below) and, in the depicted embodiment, the tank enclosure 205 is a cylindrical component that is concentric with a cylindrical atomizer 202 and cylindrical chimney 209. However, in other embodiments, these components could have other shapes, provided that that a reservoir 206 is formed between the tank enclosure 205 and the combination of the atomizer 202 and chimney 209. This reservoir 206 can be filled with an inhalable or consumable liquid (e.g., oil) and is completely sealed so that the liquid cannot escape or leak out of the reservoir 206. That is, the tank enclosure 205, chimney 209, and atomizer 202 define a sealed reservoir 206 between outer surfaces of the atomizer 202 and chimney 209, and an inner surface of the tank enclosure 205. As is explained in further detail below, liquid in the reservoir 206 can escape the reservoir 206 when the liquid enters the atomizer 202 via channels 201 formed in a liner surrounding the atomizer 202 and undergoes a phase change to vapor as it passes through the atomizer 202. The vapor will be disposed in an interior chamber 250 (see FIGS. 5A and 5B) defined within the atomizer 202 and the interior chamber 250 is in fluid communication with the mouthpiece 220 via the chimney 209 so that a user can inhale and/or consume the vapor.

Figure 4:
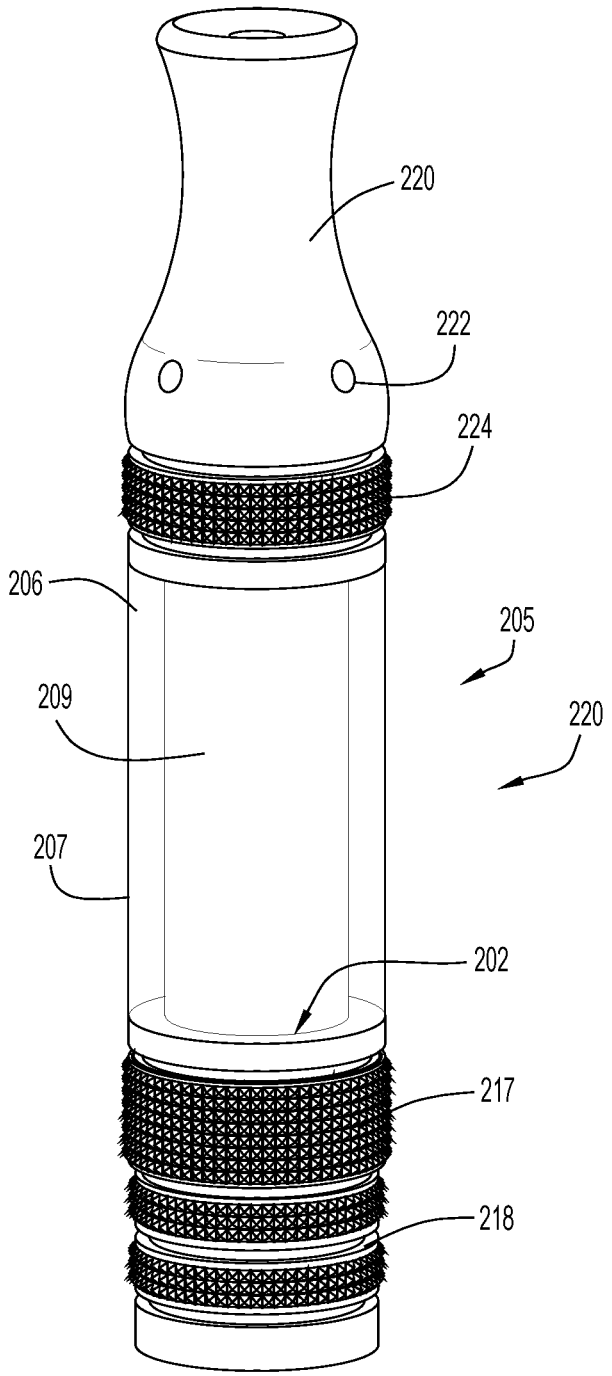
FIG. 4 illustrates a front view of the non-rebuildable tanks of FIGS. 1 and 3.

Now turning to FIGS. 2 and 4, in FIG. 2, the tank 200 is shown disconnected from the battery component 310 and in FIG. 4, the tank 200 is shown without a battery component. As can be seen, the tank enclosure 205 includes a bottom 217, a top 224 and a sidewall or sleeve 207; however, it is to be understood that in various embodiments, these components may be part of a unitary tank enclosure 205 or secured together via sealed connections. For example, in the depicted embodiment, the top 224 and bottom 217 may include via rubber or silicone gaskets that form a sealed connection with the sidewall/sleeve 207 when the top 224 and bottom 217 are fixedly coupled to the sidewall/sleeve 207 (e.g., via gluing, welding, or some other non-releasable attachment). However, in other embodiments, the tank enclosure 205 may be a unitary (e.g., one-piece) enclosure, such as a unitary glass enclosure.

Still referring to FIGS. 2 and 4, but now with reference to FIG. 1 as well, in at least some embodiments, the atomizer 202 is disposed at or adjacent the bottom 217 of the tank enclosure 205. That is, a bottom of the atomizer 202 may be coupled to the bottom 217 of the tank enclosure. Meanwhile, a top of the atomizer 202 is connected to a chimney 209 that extends to the top 224 of the tank enclosure 205 (as shown in FIGS. 1, 2, and 4). Consequently, in the depicted embodiment, the reservoir 206 is an annular chamber that extends around the atomizer 202 and chimney 209. In these embodiments, the bottom of the atomizer 202 may be sealed against the bottom 217 of the tank enclosure to prevent liquid from entering an interior chamber 250 of the atomizer 202 without passing through the atomizer 202 (and undergoing a phase change). That is, the atomizer 202 may ensure that only vapor is present in an interior chamber 250 of the atomizer 202 (so that vapor can be suctioned from the mouthpiece 220, via the chimney 209, without liquid being suctioned therewith).

Alternatively, in some embodiments, the atomizer 202 need not be secured to the bottom 217. Instead, the atomizer 202 might include a closed bottom. Additionally or alternatively, the tank 200 may not need to include a chimney 209 and the atomizer 202 could extend to the top 217 of the tank enclosure 205. That being said, it may be beneficial to locate the atomizer at the bottom 217 so that gravity causes even small amounts of liquid in reservoir 206 move into contact with the atomizer 202 when the vaporization device is right side up (as shown in FIG. 1).

Regardless of where the atomizer 202 is located, the atomizer 202 defines an interior chamber 250 (again, see FIGS. 5A and 5B) that is separate and distinct from the liquid reservoir 206, insofar as liquid from the liquid reservoir 206 cannot flow into the interior chamber 250 of the atomizer 202 as a liquid. Instead, the interior chamber 250 of the atomizer 202 provides an area in which vapor can be generated (due to a phase change of the liquid in the liquid reservoir 206) and the interior chamber 250 is in communication with the mouthpiece 220 (e.g., via chimney 209) so that a user can inhale or consume the vapor via the mouthpiece 220 as the vapor is generated. Notably, since the tank 200 presented herein does not include a bottom airflow, the interior chamber 250 defined within the atomizer 202 does not necessarily need to extend to a bottom 217 of the tank 202. Instead, in some embodiments, only the contacts 211 included in the atomizer 202 (see FIGS. 5A and 5B) can extend to the bottom 224 (to provide an electrical between a heating element 203 of the atomizer 202 and a battery 310 disposed to which the tank 200 is connected).

Moreover, in the embodiments depicted in FIGS. 1-4, the bottom 217 of the enclosure 205 includes a threaded connector 218 (e.g., a 510 threaded connector) that can mechanically connect the tank 200 to the battery component 310. Meanwhile, the heating element 203 includes contacts 211 (see FIGS. 5A and 5B) that can electrically couple the tank 200 to the battery component 310. However, in at least some embodiments (such as the depicted embodiment), neither the bottom 217 nor the connector 218 includes an opening to allow an airflow into the tank. That is, the tank does not receive any bottom airflow. Instead, the tank utilizes airflow openings 222 disposed in or adjacent to the top 224 of the tank enclosure 205, insofar as adjacent to top 224 may mean that the airflow openings 222 may be disposed on the top 224, between top 224 and mouthpiece 220, and/or on the mouthpiece 220. Thus, the contacts 211 can either extend through sealed openings in the bottom 217 and/or connector 218 (e.g., openings in the bottom 217 that are sealed around the contacts 211) or the contacts 211 can be electrically connected to the battery component 310 via the connector 218. For example, the contacts 211 may be sealed within the tank enclosure 205 (e.g., the bottom 217 and connector 218 may not include any openings) and the connector 218 may be conductive so that the connector 218 can transfer electricity between the battery component 310 and the contacts 211.

In FIGS. 1 and 2, the battery component 310 may be or include a cylindrical 1100 milliamp hour lithium ion battery or any other battery configured to supply energy for heating the inhalable product. More generally, the battery component 310 may include a power source and circuitry for delivering the current to the atomizer 202. The battery component 310 may include an actuator or power button, such as an on/off button (not shown) and a charging port, such as a micro USB charging port (not shown), that are configured to interact with and/or control the battery. Moreover, in the depicted embodiment, the battery component 310 includes a female threaded connector (to receive the male threaded connector 218 from the tank 200), but in other embodiments, this arrangement may be reversed (e.g., the tank 200 may include a female threaded connector and the battery component 310 may include a male threaded connector) or replaced with any other connector, including friction fit and/or magnetic connectors/connections. The other end (i.e., its bottom end) of the depicted battery component 310 defines a bottom of the portable vaporization devices.

In FIG. 3, two tanks 200 are depicted attached to another battery component 500. The tanks 200 in FIG. 3 are substantially the same as the tank 200 shown in FIGS. 1 and 2; FIG. 3 is simply illustrating how the tank 200 may be used interchangeably with various battery components and/or in different positions with even one battery component, such as battery component 500. In particular, in FIG. 3, the battery component can receive a tank 200 that is inserted partially into the battery component 500 in position P1. In this position, the tank 200 may connect, mechanically and electrically, to the battery component 500 via connections provided within the battery component 500. Alternatively, the tank 200 may be coupled to the battery component 500 (e.g., via a connection between connector 218 and a corresponding connector included on battery component) in a secondary position P2, which is upside-down as compared to position P1. In either position P1 or P2, the tank 200 may provide a sealed tank 200 that can function (e.g., generate vapor) without any bottom airflow.

Figure 5A:
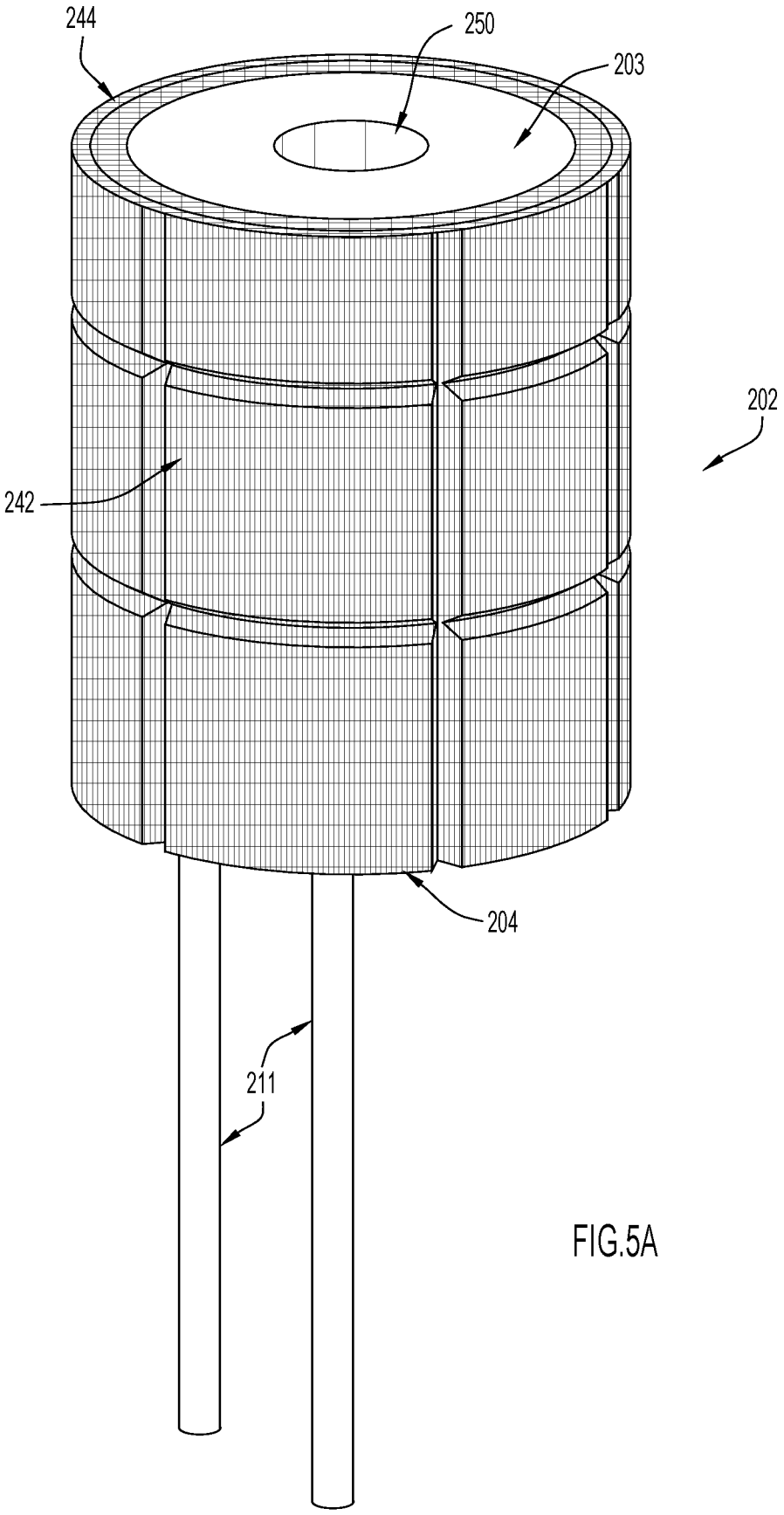
FIGS. 5A and 5B illustrate a front perspective view and a bottom perspective view, respectively, of an atomizer included in the non-rebuildable tank of FIG. 4.
Figure 5B:
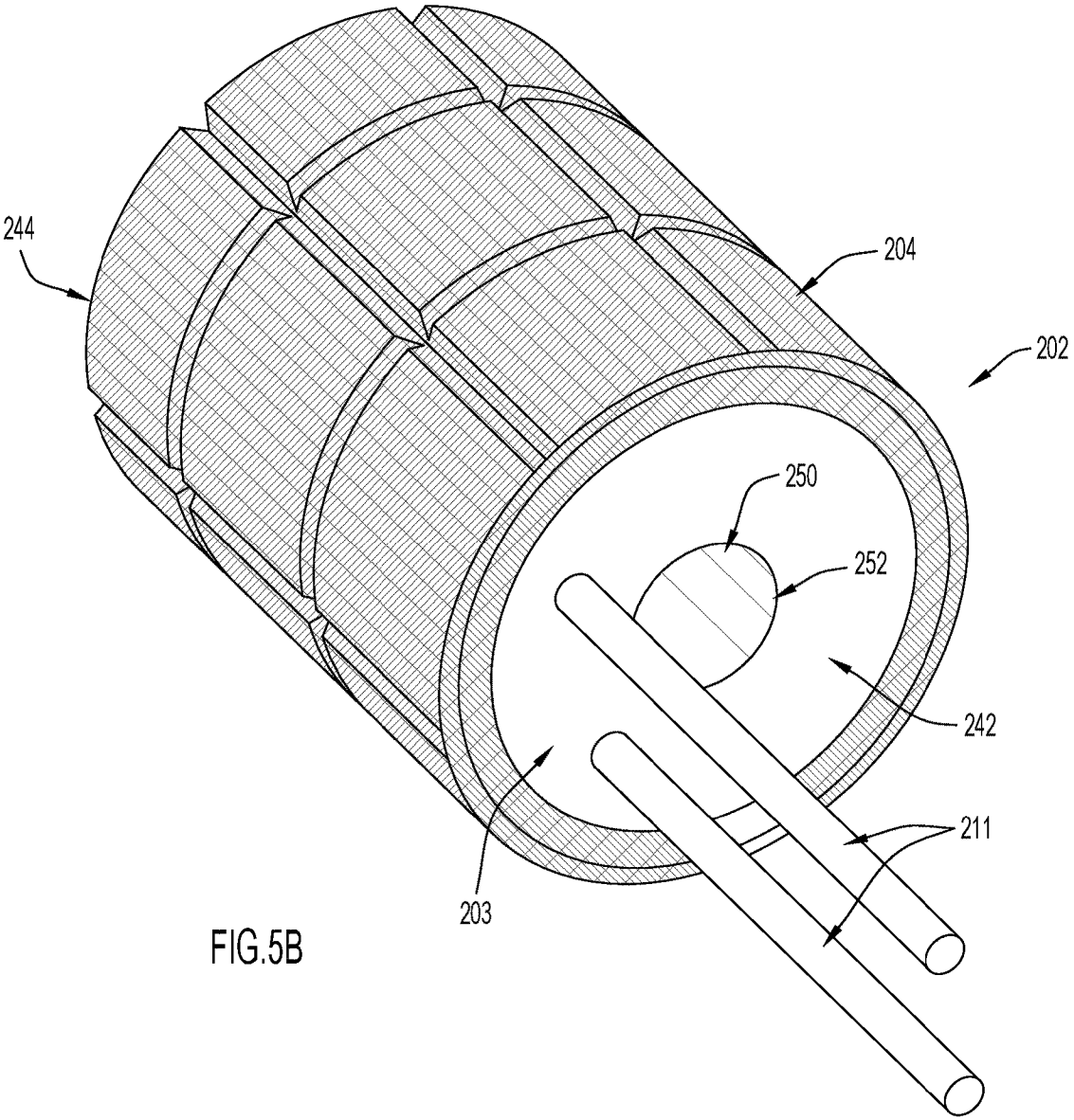

Now turning to FIGS. 5A and 5B, these Figures depict the atomizer 202 removed from the tank enclosure 205. As mentioned, the atomizer 202 includes a heating element 203 and a wick 204 (also referred to as a wicking element). The heating element 203 is an annular element, but may be or include any desirable heating components, such as a heating coil made of, for example, 30 gauge kanthal wire or ceramic, that can conductively heat an inhalable/consumable liquid to induce a phase change from liquid to vapor and so that some of the liquid can be vaporized and pass through the heating element 203. For example, the heating element 203 may be built to provide a resistance of 0.80 ohms so that energy transferred into the heating element 203 (i.e., from a battery included in battery component 310/500) causes the heating element 203 to generates heat. Since the heating element 203 is annular, the heating element defines an interior chamber 250. Thus, any vapor generated by the heating element (by inducing a phase change in liquid via heating) will naturally move into the interior chamber 250 (e.g., due to pressure principles).

The interior chamber 250 extends from a bottom 242 of the atomizer 202 to a top 244 of the atomizer 202. The top 244 is connected to a bottom end of the chimney 209 so that the interior chamber 250 is in fluid communication with a mouthpiece 220 included in or installed on the tank 200. As mentioned, in some embodiments, the bottom 242 of the atomizer 202 may abut a bottom 217 of the tank enclosure 205 so that the interior chamber 250 is separated from the liquid reservoir 206 formed between the atomizer 202 and the tank enclosure 205. Alternatively, the bottom 242 of the atomizer 202 may be closed or sealed so that the bottom of the interior chamber 250 is sealed. Regardless, liquid from reservoir 206 does not enter the interior chamber 250 of the atomizer 202 and, thus, a user will not inhale or consume any liquid with vapor. In some embodiments, the atomizer 202 may also include a liner 252 that is wrapped around an interior surface of the heating element 203 and further defines the interior chamber 250.

In order to receive power, the heating element 203 includes contacts 211. One contact is positive and one contact is negative and, thus, the tank forms a closed circuit with the any battery component to which it is connected. The contacts 211 can be directly coupled to contacts included on a battery (e.g., by extending through sealed openings in the tank enclosure 205) or can connect to contacts in a battery component via another conductor (e.g., a conductive connector 218 included on the tank 200). In at least some embodiments, the heating element 203 is the only portion or part of the atomizer 202 that receives electricity and, thus, the only portion or part of the atomizer 202 that generates heat.

The wick 204 wraps around or encases at least the outer circumference of the annular heating element 203. The wick 204 absorbs liquid from the liquid reservoir 206 (the chamber between the atomizer 202 and the tank enclosure 205) and slowly delivers the liquid to the heating element 203. The wick 204 reduces the need for airflow into the heating element and, thus, allows the tank 200 to include top airflow openings 222. Due to the position of the top airflow openings 222, the flow path from top airflow openings 222 to the atomizer 202 is much longer than a potential flow path between bottom openings and the atomizer 202. Thus, the top airflow openings 222 might reduce the amount of debris or contaminants introduced into the vapor and/or components of the atomizer 202. Since debris or contaminants may be detrimental to the vapor quality and/or the components of the atomizer 202 (e.g., contaminants may cause wear in the atomizer, even over the relatively short lifespan of a disposable tank), this improves the efficiency, quality, and lifespan of a vaporizer formed with the tank presented herein. Moreover, the elimination of bottom airflow also discourages or prevents liquid and/or vapor from leaking from the tank, which may waste product and/or create a mess for the user.

The wick 204 utilized in the embodiments presented herein is a metal or ferrite mesh wick, such as a stainless steel mesh wick. As compared to cotton or silica, metal mesh provides improved absorption rates, and, thus, can allow the heating element to generate an increased volume of vapor over a predetermined length of time as compared to atomizers including a cotton wick (or no wick). That is, a metal mesh wick 204 can increase the flow of vapor for a vaporization device, which may be preferable for many users. This increased flow also ensures that the heating element 203 remains moist and does not overheat or otherwise malfunction. Moreover, metal or ferrite mesh has a higher burn point than cotton, silica, or ceramic and, thus, the wick will be unlikely to burn when the heating element is convectively heating liquid to induce a phase change. Notably, if a wick (or any other component in the atomizer) is burnt, it will introduce an undesirable burnt flavor into the vapor.

While the invention has been illustrated and described in detail and with reference to specific embodiments thereof, it is nevertheless not intended to be limited to the details shown, since it will be apparent that various modifications and structural changes may be made therein without departing from the scope the inventions and within the scope and range of equivalents of the claims. For example, the batteries 310 and 500 are not the only components that can be used to supply power to tank 200. As another example, the shapes of tank enclosure 205 and/or mouthpiece 220 shown in the Figures are not intended to be limiting and, in different embodiments, these components (as well as other components described herein) may have different shapes and/or sizes. In addition, various features from one of the embodiments may be incorporated into another of the embodiments. Accordingly, it is appropriate that the appended claims be construed broadly and in a manner consistent with the scope of the disclosure as set forth in the following claims.

It is also to be understood that the non-rebuildable tank of the present invention, or portions thereof, aside from the metal mesh wick (which should be a metal or ferrite mesh) may be fabricated from any suitable material or combination of materials, provided that the device, or portions thereof, can function as described herein (i.e., withstand heating forces and/or form sealed connections). Example materials include plastic, foamed plastic, wood, cardboard, pressed paper, metal, supple natural or synthetic materials including, but not limited to, cotton, elastomers, polyester, plastic, rubber, derivatives thereof, and combinations thereof. Suitable plastics may include high-density polyethylene (HDPE), low-density polyethylene (LDPE), polystyrene, acrylonitrile butadiene styrene (ABS), polycarbonate, polyethylene terephthalate (PET), polypropylene, ethylene-vinyl acetate (EVA), or the like. Suitable foamed plastics may include expanded or extruded polystyrene, expanded or extruded polypropylene, EVA foam, derivatives thereof, and combinations thereof. The metal mesh wick, on the other hand, may be manufactured from any suitable metal or ferrite.

Finally, it is intended that the present invention cover the modifications and variations of this invention that come within the scope of the appended claims and their equivalents. For example, it is to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

What is claimed is:

1. A non-rebuildable tank for a portable vaporization device comprising:

a sealed tank enclosure containing a vaporizable liquid;

an annular heating element that is positioned within the tank enclosure and heats the vaporizable liquid via direct convective heating to cause a phase change of the vaporizable liquid from liquid to vapor when receiving current from a power source; and a ferrite wick that surrounds the annular heating element and is configured to control a flow of the vaporizable liquid to the annular heating element, wherein the ferrite wick does not receive current.

2. The non-rebuildable tank for a portable vaporization device of claim 1, wherein the vaporizable liquid is a consumable or inhalable product.

3. The non-rebuildable tank for a portable vaporization device of claim 1, wherein the vaporizable liquid is disposed in a reservoir that is defined between an outer surface of the annular heating element and an inner surface of the sealed tank enclosure.

4. The non-rebuildable tank for a portable vaporization device of claim 3, wherein the annular heating element defines an interior chamber that is separate from the reservoir.

5. The non-rebuildable tank for a portable vaporization device of claim 4, wherein the vaporizable liquid undergoes the phase change as it moves from the reservoir to the interior chamber so that liquid is disposed in the reservoir and vapor is disposed in the interior chamber.

6. The non-rebuildable tank for a portable vaporization device of claim 4, further comprising:

a mouthpiece; and a chimney, wherein the chimney extends between the interior chamber and the mouthpiece so that the reservoir is further defined between an outer surface of the chimney and the inner surface of the sealed tank enclosure, the chimney including channels configured to direct the vaporizable liquid towards the ferrite wick.

7. The non-rebuildable tank for a portable vaporization device of claim 1, wherein the non-rebuildable tank is a sealed unit.

8. The non-rebuildable tank for a portable vaporization device of claim 1, wherein the tank enclosure includes a top and a bottom, the bottom being completely sealed.

9. The non-rebuildable tank for a portable vaporization device of claim 8, further comprising:

top airflow openings disposed in the top of the tank enclosure that allow air to be drawn into the annular heating element.

10. The non-rebuildable tank for a portable vaporization device of claim 9, wherein the top airflow openings are the only airflow openings included in the non-rebuildable tank.

11. A portable vaporization device comprising:

a battery component configured to generate current; and a non-rebuildable tank that is mechanically and electrically coupleable to the battery component, the non-rebuildable tank comprising:

a sealed tank enclosure containing a vaporizable liquid;

an annular heating element that is positioned within the tank enclosure and heats the vaporizable liquid via direct convective heating to cause a phase change of the vaporizable liquid from liquid to vapor when receiving the current from the battery component; and a ferrite wick that surrounds the annular heating element and is configured to control a flow of the vaporizable liquid to the annular heating element, wherein the ferrite wick does not receive current.

12. The portable vaporization device of claim 11, wherein the vaporizable liquid is disposed in a reservoir that is defined between an outer surface of the annular heating element and an inner surface of the sealed tank enclosure, and wherein the annular heating element defines an interior chamber that is separate from the reservoir.

13. The portable vaporization device of claim 12, wherein the vaporizable liquid undergoes the phase change as it moves from the reservoir to the interior chamber so that liquid is disposed in the reservoir and vapor is disposed in the interior chamber.

14. The portable vaporization device of claim 12, wherein the non-rebuildable tank further comprises:

a mouthpiece; and a chimney, wherein the chimney extends between the interior chamber and the mouthpiece so that the reservoir is further defined between an outer surface of the chimney and the inner surface of the sealed tank enclosure, the chimney including channels configured to direct the vaporizable liquid towards the ferrite wick.

15. The portable vaporization device of claim 11, wherein the non-rebuildable tank is a sealed unit.

16. The portable vaporization device of claim 11, wherein the tank enclosure includes:

a top;

a bottom that is completely sealed; and top airflow openings disposed in the top that allow air to be drawn into the annular heating element.

17. The portable vaporization device of claim 12, wherein the ferrite wick is disposed in the reservoir, between the outer surface of the annular heating element and the inner surface of the sealed tank enclosure.

18. The non-rebuildable tank for a portable vaporization device of claim 3, wherein the ferrite wick is disposed in the reservoir, between the outer surface of the annular heating element and the inner surface of the sealed tank enclosure.

19. The portable vaporization device of claim 16, wherein the bottom is removably coupleable to the battery component to mechanically and electrically couple the non-rebuildable tank to the battery component.

20. The non-rebuildable tank for a portable vaporization device of claim 9, wherein the bottom is removably coupleable to a battery component to mechanically and electrically couple the non-rebuildable tank to the battery component.

* * * * *